US005089785A

United States Patent [19]

Hand

[11] Patent Number: 5,089,785

[45] Date of Patent: Feb. 18, 1992

[54] SUPERCONDUCTING LINEAR ACCELERATOR LOADED WITH A SAPPHIRE CRYSTAL

[75] Inventor: Louis N. Hand, Ithaca, N.Y.

[73] Assignee: Cornell Research Foundation, Inc., Ithaca, N.Y.

[21] Appl. No.: 386,307

[22] Filed: Jul. 27, 1989

[51] Int. Cl.[5] ..... H01J 23/00

[52] U.S. Cl. ..... 328/233; 313/359.1; 315/5.41

[58] Field of Search ..... 328/233, 235; 313/359.1; 315/5.41; 335/216; 505/805, 806; 333/219.1, 227, 99 S

[56] References Cited

U.S. PATENT DOCUMENTS

| | | | |
|---|---|---|---|
| 3,153,767 | 10/1964 | Kyhl | 333/31 |
| 3,336,495 | 9/1967 | Loew | 328/233 |
| 3,501,734 | 3/1970 | Knapp | 328/233 |
| 3,514,662 | 5/1970 | Eldridge | 315/5.41 |
| 4,211,954 | 7/1980 | Swenson | 315/5.41 |
| 4,229,704 | 10/1980 | Lewis | 328/233 |
| 4,712,074 | 12/1987 | Harvey | 328/233 |
| 4,757,278 | 7/1988 | Dick | 331/3 |
| 4,920,093 | 4/1990 | Nonaka et al. | 252/521 X |

OTHER PUBLICATIONS

Braginskii et al, The Properties of Superconducting Resonators on Sapphire, IEEE Transactions on Magnetics, vol. 17, No. 1, 1/1981, pp. 955–957.

*Primary Examiner*—Donald J. Yusko
*Assistant Examiner*—Michael Horabik
*Attorney, Agent, or Firm*—Jones, Tullar & Cooper

[57] ABSTRACT

A dielectric loaded superconducting linear accelerator (linac) is disclosed which includes an accelerating structure formed of a cylindrical sapphire crystal having a centrally disposed passage for reception of a particle beam to be accelerated. A superconductive material layer, such as niobium, surrounds the exterior surface of the sapphire crystal. When the linac is operated at a superconductive temperature of less than 2°K, the loss tangents of the sapphire and niobium are very low so that the linac operates very efficiently. The uniform shape of the sapphire crystal insures that wakefields generated by the charged particles as they pass through the linac will be minimized. The linac has a very high Q which enables it to store energy over a long period of time and reduces peak power requirements.

7 Claims, 2 Drawing Sheets

FIG. 2A f = 3 GHz

| $r_o$ (mm) | $r_i$ (mm) | Vg/C | $k_{loss}$ (V/pC-m) | $R_{shunt}/Q$ (kΩ/m) | $R_{shunt}$ (Ω/m) | W (j/m) | $P_{inst}$ (kW/m) | D (%) | $B_\phi$,wall (gauss) |
|---|---|---|---|---|---|---|---|---|---|
| 1.59 | 12.13 | .087 | 22.3 | 4.7 | $1.4 \cdot 10^{12}$ | 112 | 7.0 | 0.14 | 5440 |
| 3.18 | 12.94 | .087 | 18.4 | 3.9 | $1.2 \cdot 10^{12}$ | 136 | 8.6 | 0.11 | 5940 |
| 15.10 | 22.90 | .021 | 6.7 | 1.4 | $0.4 \cdot 10^{12}$ | 375 | 23.5 | 0.04 | 8010 |

FIG. 2B f = 9 GHz

| $r_o$ (mm) | $r_i$ (mm) | Vg/C | $k_{loss}$ (V/pC-m) | $R_{shunt}/Q$ (kΩ/m) | $R_{shunt}$ (Ω/m) | W (j/m) | $P_{inst}$ (kW/m) | D (%) | $B_\phi$,wall (gauss) |
|---|---|---|---|---|---|---|---|---|---|
| 0.48 | 14.3 | .087 | 57 | 4.0 | $1.2 \cdot 10^{12}$ | 44 | 8.3 | 0.12 | 2840 |
| 0.53 | 4.0 | .087 | 201 | 14.2 | $4.3 \cdot 10^{12}$ | 12 | 2.3 | 0.43 | 5440 |
| 1.06 | 4.3 | .087 | 165 | 11.7 | $3.5 \cdot 10^{12}$ | 15 | 2.9 | 0.35 | 5940 |
| 5.04 | 7.6 | .021 | 60 | 4.2 | $1.3 \cdot 10^{12}$ | 42 | 7.8 | 0.13 | 8010 |

FIG. 2C f = 27 GHz

| $r_o$ (mm) | $r_i$ (mm) | Vg/C | $k_{loss}$ (V/pC-m) | $R_{shunt}/Q$ (kΩ/m) | $R_{shunt}$ (Ω/m) | W (j/m) | $P_{inst}$ (kW/m) | D (%) | $B_\phi$,wall (gauss) |
|---|---|---|---|---|---|---|---|---|---|
| 0.16 | 4.75 | .087 | 513 | 12.1 | $3.6 \cdot 10^{12}$ | 4.9 | 2.8 | .36 | 2840 |
| 0.18 | 1.35 | .087 | 1810 | 42.7 | $12.8 \cdot 10^{12}$ | 1.4 | 0.8 | 1.3 | 5440 |
| 0.35 | 1.44 | .087 | 1486 | 35.0 | $10.5 \cdot 10^{12}$ | 1.7 | 1.0 | 1.1 | 5940 |
| 1.59 | 2.46 | .048 | 567 | 13.4 | $4.0 \cdot 10^{12}$ | 4.4 | 2.5 | 0.4 | 7930 |
| 1.68 | 2.54 | .021 | 541 | 12.7 | $3.8 \cdot 10^{12}$ | 4.6 | 2.6 | 0.4 | 8010 |

SUPERCONDUCTING LINEAR ACCELERATOR LOADED WITH A SAPPHIRE CRYSTAL

BACKGROUND OF THE INVENTION

The present invention relates in general to a superconducting linear particle accelerator which is loaded with a sapphire dielectric.

There is currently a need to design a linear accelerator (linac) suitable for a TeV $e^+/e^-$ linear collider. This energy level requires that a conventional copper linac have an energy source capable of producing rf peak power levels on the order of 100 MW/meter. The need for such a high rf peak power presents difficult practical problems. This concept is pursued nevertheless because it is believed to be a way to achieve the high accelerating gradient needed to provide TeV energies within reasonable lengths (on the order of 10 km). If it were possible to make superconducting linacs with comparable gradients, it would be preferable to do so, since the demands on peak rf power would be significantly less. At present, however, state-of-the-art superconducting linacs have gradients only on the order of 5 MV/m, although gradients as high as 20 MV/m with Nb cavities have been produced under carefully controlled laboratory conditions. It is believed that the ultimate limit of such cavities may be as high as 30 MV/m, although the cost to manufacture such an accelerator would be prohibitive. A superconducting linac would be much longer than a conventional copper linac, since the gradients achieved so far are about ten times lower than for copper linacs. The advantage of low peak power is traded against the disadvantage of greater length.

Conventional copper linacs employ irises to slow down the phase velocity of the accelerating wave. These irises are spaced along the length of the linac, and must be manufactured and positioned with extreme precision to avoid problems with wakefields that are generated by charged particles (e.g. electrons) as they are accelerated through the irises. An alternative approach is to load a cylindrical waveguide with dielectric material rather than with irises. This is advantageous in its simplicity of construction. Unfortunately, loss tangents of typical dielectric materials are several times $10^{-4}$ at best, so there is significant rf heating in the dielectric, in addition to the skin effect ohmic losses in the conductor. It is also possible that rf breakdown could be worse for the dielectric linac because the electric field is along the dielectric surface. As a result, prior dielectric linac structures would not be suitable for the high energy requirements of a 1 TeV linear collider. What is needed is a linac structure that permits the simpler structure of a dielectric linac in a superconducting environment.

SUMMARY OF THE INVENTION

It is therefore the object of the present invention to provide a linear accelerator which is simple in construction, and at the same time has a low loss tangent to permit the use of high field gradients combined with low rf peak power.

This and other objects of the invention are achieved through provision of a superconducting linac structure which is loaded with a crystal sapphire dielectric. It has been discovered that crystals of pure sapphire have very low loss tangents at low temperatures. Advances in crystal growing techniques have made it possible to grow single crystals as large as 32 cm. in diameter. Sapphire crystals are optically clear and free of any visible light scattering or milkiness. The advantages of this material at very low temperatures include loss tangents less than $2\times10^{-10}$, an extremely low coefficient of thermal expansion, high thermal conductivity, great mechanical strength, a DC breakdown strength of 48 MV/m and dielectric constants of 11.5 along the symmetry axis and 9.5 perpendicular to the symmetry axis.

The linac is constructed by using a cylindrical sapphire crystal having a centrally disposed passage for reception of a particle beam to be accelerated, and an outer conductive layer of superconductive material such as Nb. If the linac is operated at a temperature below 2° K., gradients approaching 100 MV/m could quite possibly be achieved. The advantage of this type of accelerating structure is that the peak electric field at the wall of the outer conductor is about 1/6th of the accelerating field, rather than the factor of 2-3 intrinsic to the iris-loaded structure. The electric field at the outer wall is purely radial, while the magnetic field is purely azimuthal. In addition, the simplicity of the structure substantially reduces cost, since there are no precision irises to be manufactured and aligned. The linac also has a very high Q, which enables it to store energy over a long period of time. This reduces peak power requirements, since the energy level can be gradually built up in the linac over time.

BRIEF DESCRIPTION OF THE DRAWINGS

The foregoing and additional objects, features and advantages of the present invention will become apparent to those of skill in the art from the following detailed consideration thereof, taken in conjunction with the accompanying drawings in which.

DETAILED DESCRIPTION OF THE PREFERRED EMBODIMENT

Figure 1:
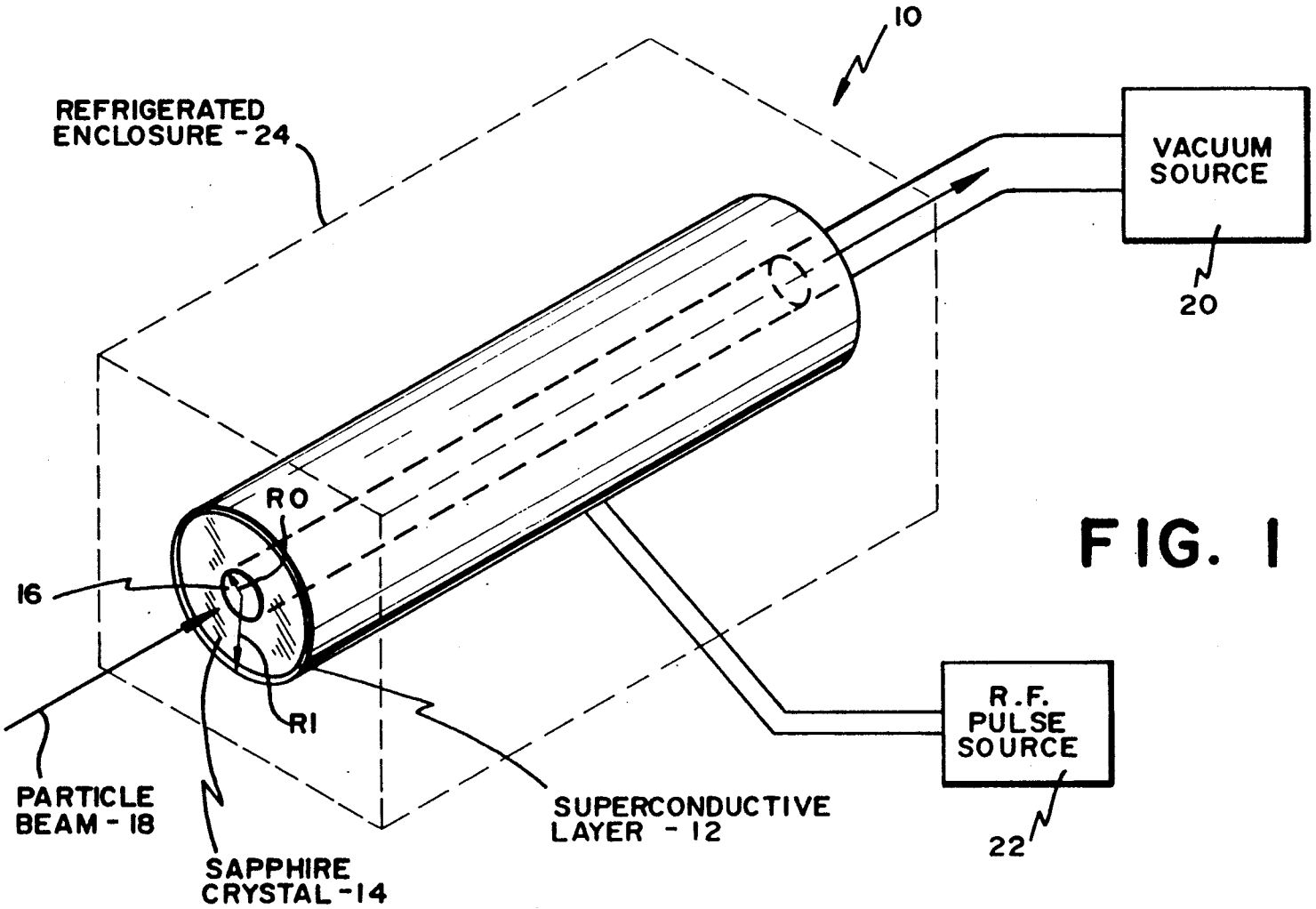
FIG. 1 is a diagramatic perspective view of a linac structure constructed in accordance with the present invention; and, FIGS. 2A-C are tables illustrating calculations of operational parameters at different operating frequencies for a linac constructed in accordance with the present invention.

Turning now to a more detailed consideration of the invention, FIG. 1 illustrates a linac 10 which includes an outer cylindrical conductive layer 12 that is preferably formed from a superconductive material such as Niobium (Nb), and is approximately 1 micron thick. The layer 12 surrounds an exterior wall of a cylindrical crystal of sapphire dielectric 14 of radius $r_1$ which has a centrally disposed longitudinal passage 16 of radius $r_0$ for reception of a particle beam 18 to be accelerated. In FIG. 1, the conductive layer 12 is shown in contact with the sapphire crystal 14, although it will be understood that layer 12 could be spaced away from the exterior wall of the crystal 14. A vacuum source 20 is connected to the passage 16 to maintain the passage in an evacuated state as is conventional. As is also conventional, a rf generator 22 is connected to the linac 10 which provides an accelerating voltage. The linac 10 is disposed in a refrigerated enclosure 24 which maintains the linac at a superconducting temperature.

With the linac 10 constructed as described above and operated at a temperature below 2° K., it may be possible to achieve gradients of approximately 100 MV/m, provided that the rf breakdown strength of sapphire is at least twice the DC breakdown strength, which is likely to be true. Special problems associated with breakdown along the inner surface of the passage 16 must also be avoided. In this regard it may be necessary to pay special attention to the nature of the inner surface and to the need to avoid absorbed impurities such as water vapor. Assuming that the possible problems mentioned above do not exist, or can be overcome, a great advantage of this type of accelerating structure is that the peak electric field at the wall is about 1/6 of the accelerating field, rather than the factor of 2-3 intrinsic to the iris-loaded structure. The electric field at the outer wall is purely radial, while the magnetic field is purely azimuthal. The accelerating mode is assumed to be TMO1.

For a gradient of 100 MV/m, the magnetic field at the wall is about 6000 gauss. This is high, and is beyond the theoretical limit of 2000 gauss for Nb. There is, however, the alternative of using A15 compounds such as $Nb_3Ge$, $V_3Si$, or NbN, and it is possible that a higher H field could be achieved by using them.

It is also possible that transverse wakefields will be much smaller than in the case of an iris-loaded structure, since in that case the wake is due mostly to the irises. The scaling law for these wakes creates extremely tight manufacturing and alignment tolerances for the iris-loaded case. These tolerances place a practical limit on the maximum possible rf frequency which can be used, but may not pose a problem in the present invention.

FIGS. 2A-C are tables based on calculations showing what a sapphire crystal linac might be like for various operating frequencies (3 GHz, 9 GHz, and 27 GHz). The birefringence of sapphire has been neglected and a dielectric constant of 11.5 in all directions has been assumed, so the calculations are only an approximate guide. However, the azimuthal magnetic field at the wall is computed using 9.5 instead, as an approximate treatment of the birefringent effects.

The tables give, for each of the three frequencies, the values of $r_0$ and $r_1$ for $v_{ph}=c$ (c=speed of light), the group velocity $v_g/c$, the loss parameter $k_{loss}$ (defined as $V^2/4W$, where V is the accelerating gradient and W is the energy stored/meter), the value of $R_{shunt}/Q$, and $R_{shunt}$ (assuming that $Q=3.10^8$). $P_{inst}$ is the instantaneous rate of rf power loss from heating of the cavity. All of the above values are calculated for an accelerating gradient of 100 MV/meter and travelling wave operation is assumed.

From the tables it can be seen that this type of linac is characterized by extremely high shunt impedance. Typical values for conventional accelerator structures are around 20-50 Megohms/meters. It can be seen from the tables that the very high Q produces very high $R_{shunt}$ values. However the other side of the coin is that ohmic and dielectric losses must be kept very small because of the very low operating temperatures (2° K. or less). If it is assumed that for every watt of cooling at this low temperature 1000 watts of "wall-plug" power is needed (typically a factor of 280 is needed to cool at 4.2° K. for example), then 10 watts/meter of rf power loss will require a short duty cycle to avoid excessive refrigeration costs. The maximum possible duty cycle D is set by the heat loss. In the tables D varies, but is typically 0.1%-1.0%.

There is an important trade-off between peak rf power and refrigeration cost. In the operation of the linac 10, the rf generator 22 is pulsed on at a power level such that the stored energy reaches the level needed for the accelerating gradient. The electrons or positrons are then injected perhaps in multiple bunches. If the stored energy is 10 joules/meter and the acceleration gradient is 100 MV/m, that is $1.6.10^{-11}$ j/electron/meter, so a pulse of $10^{10}$ electrons will extract only 1.6% of the stored energy. After the bunch or bunches are accelerated, the rf must be removed to keep the losses low. It will be desirable to use very short rf pulses (<50-100 nsec). This does not avoid the need to remove all of the rf energy to avoid excessive refrigeration costs, however.

In conclusion, the present invention provides a superconducting linac which is loaded with a low loss dielectric, such as sapphire. The resulting structure is simple in construction which is beneficial from a cost standpoint and may substantially reduce wakefields. The low loss of the sapphire should permit the use of high accelerating gradients, and the high Q of the structure substantially reduces peak power requirements since the structure is capable of storing energy over a long period of time, and therefore the power can be gradually fed into it.

Although the invention has been disclosed in terms of a preferred embodiment, it will be understood that numerous variations and modifications could be made thereto without departing from the scope and spirit thereof as set forth in the following claims.

I claim:

1. An accelerating structure for a linear accelerator comprising:

a sapphire crystal having a passage disposed therein for reception of a particle beam to be accelerated; and, a superconductive material layer surrounding and disposed on an exterior wall of said crystal.

2. The accelerating structure of claim 1, wherein said superconductive material is selected from the group consisting of Nb, $Nb_3Ge$, $V_3Si$, or NbN.

3. An accelerating structure for a linear accelerator comprising:

a cylindrical sapphire crystal having a centrally disposed passage therein for reception of a particle beam to be accelerated; and, a superconductive material layer surrounding on an exterior wall of said cylindrical sapphire crystal.

4. The accelerating structure of claim 3, wherein said superconductive material is chosen from the group consisting of Nb, $Nb_3Ge$ or $V_3Si$.

5. A superconducting linear accelerator comprising:

an accelerating structure including a sapphire crystal having a passage disposed therein for reception of a particle beam to be accelerated and an outer layer of superconductive material;

means to create a vacuum in to said passage in said crystal;

means to supply a pulsed RF voltage to said accelerator structure;

means to supply a particle beam to be accelerated to said passage; and, means to cool said accelerating structure to a temperature at which said coating is superconductive.

6. The linear accelerator of claim 5 wherein said low loss dielectric material crystal is cylindrical in shape, and said passage is centrally disposed in a longitudinal direction in said crystal.

7. The linear accelerator of claim 6, wherein said superconductive material is selected from the group consisting of Nb, $Nb_3Ge$, $V_3Si$, or NbN.

* * * * *